US012123430B2

(12) United States Patent
Yu et al.

(10) Patent No.: US 12,123,430 B2
(45) Date of Patent: Oct. 22, 2024

(54) INLET GUIDE VANE MECHANISM FOR CENTRIFUGAL COMPRESSOR, CENTRIFUGAL COMPRESSOR AND REFRIGERATION SYSTEM

(71) Applicant: Carrier Corporation, Palm Beach Gardens, FL (US)

(72) Inventors: Lei Yu, Shanghai (CN); Fujin Feng, Shanghai (CN); Huiliang Zhang, Shanghai (CN); Qunyi Ma, Shanghai (CN); Vishnu Sishtla, Palm Beach Gardens, FL (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 18/302,530

(22) Filed: Apr. 18, 2023

(65) Prior Publication Data

US 2023/0332621 A1 Oct. 19, 2023

(51) Int. Cl.

| | |
|---|---|
| ***F04D 29/42*** | (2006.01) |
| ***F04D 17/10*** | (2006.01) |
| ***F04D 29/44*** | (2006.01) |
| ***F25B 31/02*** | (2006.01) |

(52) U.S. Cl.

CPC ..... *F04D 29/444* (2013.01); *F04D 17/10* (2013.01); *F04D 29/4213* (2013.01); *F25B 31/026* (2013.01)

(58) Field of Classification Search

CPC .... F04D 29/444; F04D 17/10; F04D 29/4213; F25B 31/026

See application file for complete search history.

(56) References Cited

U.S. PATENT DOCUMENTS

2007/0154302 A1* 7/2007 Sconfietti ..... F04D 29/462 415/191
2009/0205362 A1* 8/2009 Haley ..... F04D 27/0246 29/889.4
2014/0105736 A1* 4/2014 Kiriaki ..... F04D 29/441 415/182.1

(Continued)

FOREIGN PATENT DOCUMENTS

CN 202209314 U 5/2012

OTHER PUBLICATIONS

Extended European Search Report received for EP Application No. 23166039.0, mailed on Sep. 13, 2023, 06 Pages.

*Primary Examiner* — Shafiq Mian
(74) *Attorney, Agent, or Firm* — Souad Hakim

(57) ABSTRACT

An inlet guide vane mechanism comprises: a flow guide body having a front end section, a middle section and a rear end section, wherein the front end section, the middle section and the rear end section respectively have streamline contours in symmetry about the impeller axis and are transitionally connected by smooth curved surfaces, the flow guide body comprises an air inlet pipe arranged along the impeller axis, one end of the air inlet pipe being fixed at the front end section of the flow guide body, and the other end thereof being fixed at the rear end section of the flow guide body; a support structure for fixing the flow guide body at the air inlet end of the centrifugal compressor; and a plurality of inlet guide vanes rotatably fixed in the circumferential direction of the middle section of the flow guide body through a rotating shaft thereof, respectively.

11 Claims, 4 Drawing Sheets

(56) References Cited

U.S. PATENT DOCUMENTS

| | | | | |
|---|---|---|---|---|
| 2015/0267559 | A1* | 9/2015 | Ishibashi | F04D 29/4206 29/889.22 |
| 2015/0377250 | A1* | 12/2015 | Sishtla | F25B 1/053 415/191 |
| 2017/0152860 | A1* | 6/2017 | Miclea-Bleiziffer | F01D 5/141 |
| 2019/0178255 | A1 | 6/2019 | Leighty | |

* cited by examiner

INLET GUIDE VANE MECHANISM FOR CENTRIFUGAL COMPRESSOR, CENTRIFUGAL COMPRESSOR AND REFRIGERATION SYSTEM

CROSS REFERENCE TO RELATED APPLICATIONS

This application claims priority to Chinese Patent Application No. 202210404275.6 filed on Apr. 18, 2022, which is incorporated by reference herein in its entirety.

FIELD OF THE INVENTION

The present invention relates to the field of centrifugal compressors, in particular to an inlet guide vane (IGV) mechanism for centrifugal compressors, and also relates to a centrifugal compressor provided with the IGV mechanism, and a refrigeration system provided with the centrifugal compressor.

BACKGROUND OF THE INVENTION

At present, a compressor is a fluid machinery that boosts low-pressure gas into high-pressure gas. It takes in low-temperature and low-pressure refrigerant gas from the air suction pipe, drives the impeller to pressurize the refrigerant gas through operation of the motor, and discharges high-temperature and high-pressure refrigerant gas to the air exhaust pipe to power the refrigeration cycle.

Currently, centrifugal compressors mostly employ adjustable IGV mechanism to adjust working conditions. Specifically, the IGV mechanism controls the quantity of flow of the gas flowing into the compressor body by adjusting the opening of the inlet guide vanes. However, the existing IGV mechanism still has drawbacks and deficiencies in aspects such as structural configuration, gas flow conditions, noise reduction, etc., which can be further improved and optimized.

SUMMARY OF THE INVENTION

In view of the above, according to a first aspect of the present invention, an IGV mechanism for a centrifugal compressor is provided, which effectively solves the above problems and problems in other aspects in the prior art. In an IGV mechanism for a centrifugal compressor according to the present invention, the IGV mechanism comprises:

- a flow guide body having a front end section, a middle section and a rear end section, wherein the front end section, the middle section and the rear end section respectively have streamlined contours in symmetry about the impeller axis and are transitionally connected by smooth curved surfaces, the flow guide body comprises an air inlet pipe arranged along the impeller axis, one end of the air inlet pipe being fixed at the front end section of the flow guide body, and the other end thereof being fixed at the rear end section of the flow guide body;
- a support structure for fixing the flow guide body at the air inlet end of the centrifugal compressor; and
- a plurality of inlet guide vanes rotatably fixed in the circumferential direction of the middle section of the flow guide body through a rotating shaft, respectively.

In still another embodiment of the IGV mechanism according to the present invention, the support structure comprises:

- an annular support body fixed at the end cover of the centrifugal compressor; and
- a plurality of support rods, wherein one end of the plurality of support rods are fixedly connected with the front end section of the flow guide body, and the other end thereof are fixedly connected with the support body.

In another embodiment of the IGV mechanism according to the present invention, the plurality of support rods are a plurality of airfoil blades, wherein the number of the plurality of airfoil blades is the same as the number of the plurality of inlet guide vanes, the plurality of airfoil blades and the plurality of inlet guide vanes coincide in the radial direction of the flow guide body as viewed from the direction of the impeller axis, and the rotating shaft of the inlet guide vanes is arranged on the front side of the corresponding inlet guide vanes.

In yet another embodiment of the IGV mechanism according to the present invention, the number of the plurality of support rods is at least two, and at least two of the support rods are arranged in a radial direction along the front end section of the flow guide body.

In still another embodiment of the IGV mechanism according to the present invention, the flow guide body comprises a first housing half and a second housing half, wherein the first housing half defines the space of the front end section, and the second housing half defines the space of the middle section and the rear end section.

In another embodiment of the IGV mechanism according to the present invention, the flow guide body is a hollow spindle-like structure, wherein the radius of the partially spherical surface of the middle section is greater than the maximum radius of the front end section and the maximum radius of the rear end section, and the maximum radius of the front end section is greater than the maximum radius of the rear end section.

In yet another embodiment of the IGV mechanism according to the present invention, the inner wall of the cylindrical shell where the plurality of inlet guide vanes are located is provided with a partially spherical surface, and the vane roots of the plurality of inlet guide vanes are provided with a shape adapted to the partially spherical surface on the inner wall of the cylindrical shell; the middle section is provided with a partially spherical surface, and the vane tips of the plurality of inlet guide vanes are provided with a shape adapted to the partially spherical surface of the middle section.

In still another embodiment of the IGV mechanism according to the present invention, the flow guide body and the support structure are made of metal and formed by casting or forging.

In addition, according to a second aspect of the present invention, a centrifugal compressor provided with an impeller hub and the aforementioned IGV mechanism is further provided.

In another embodiment of the centrifugal compressor according to the present invention, the front end of the impeller hub is provided with a nose, and the surface profile of the rear end section of the flow guide body is discontinuous with a surface profile of the nose.

Furthermore, according to a third aspect of the present invention, a refrigeration system provided with the aforementioned centrifugal compressor is further provided.

It can be appreciated that an IGV mechanism for a centrifugal compressor of the present invention can reduce various flow losses when the inlet guide vanes rotate, thereby improving the efficiency of the centrifugal compressor. In particular, when the centrifugal compressor is under low load conditions, the stability of air supply is guaranteed. In addition, the IGV mechanism can effectively avoid aerodynamic noise.

BRIEF DESCRIPTION OF THE DRAWINGS

The technical solutions of the present invention will be described in further detail below in conjunction with the accompanying drawings and embodiments, wherein.

DETAILED DESCRIPTION OF EMBODIMENT(S) OF THE INVENTION

The technical solutions in the embodiments of the present invention will be clearly and completely described below with reference to the accompanying drawings in the embodiments of the present invention. Obviously, the embodiments described are only a part but not all of the embodiments of the present invention. Based on the embodiments of the present invention, all other embodiments obtained by those skilled in the art without creative efforts shall fall within the protection scope of the present invention.

It should be noted that orientation terms such as upper, lower, left, right, front, rear, inner side, outer side, front side, top and bottom mentioned or possibly mentioned in the present invention are defined relative to the configurations illustrated in the respective drawings. They are relative concepts, so they may change accordingly according to their different locations and different states of use. Therefore, these and other orientation terms shall not be construed as restrictive terms.

In addition, expressions such as "first", "second", etc. in the present invention are only for descriptive purposes, and shall not be construed as indicating or implying their relative importance or implicitly indicating the number of indicated technical features. Thus, a feature defined with "first", "second" may expressly or implicitly include at least one of that feature. In the depiction of the present invention, "a plurality of" means at least two, such as two, three, etc., unless otherwise expressly and specifically defined.

In the present invention, unless otherwise expressly specified and defined, the terms "connect", "fix", and the like should be understood in a broad sense. For example, "fix" may be a fixed connection, a detachable connection, or integration; it may be a mechanical connection, or an electric connection; it may be a direct connection, or an indirect connection through an intermediate medium; and it may be an internal communication between two elements, or an interactive relationship between two elements, unless otherwise explicitly defined. For those skilled in the art, the specific meanings of the above terms in the present invention can be understood according to specific situations.

Figure 1:
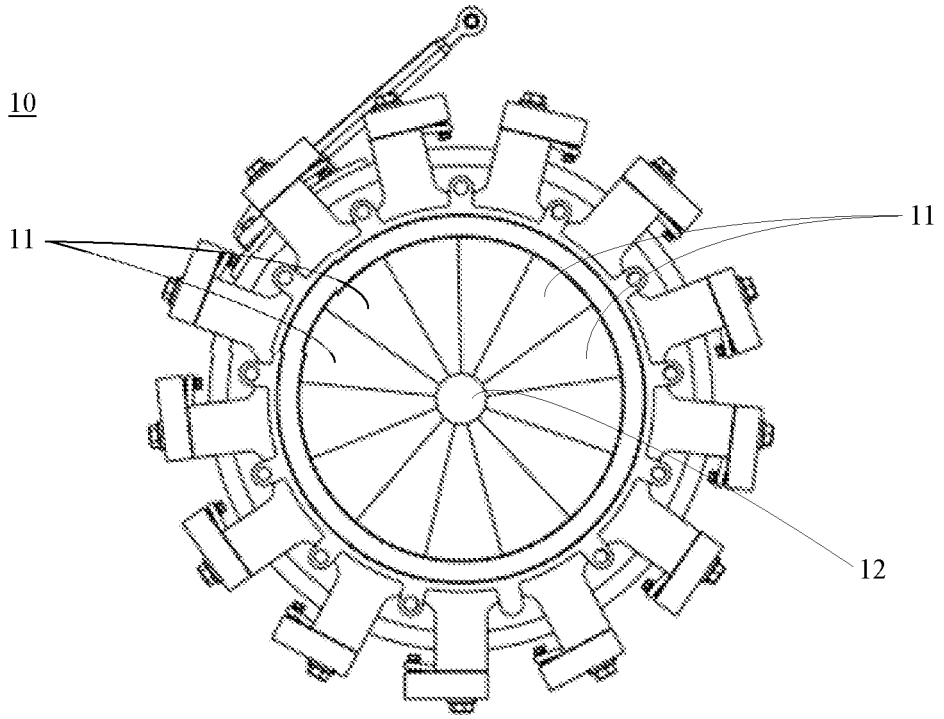
FIG. 1 shows a front view of an IGV mechanism according to the prior art.

It is known to those skilled in the art that the IGV mechanism is a critical component of a centrifugal compressor. Generally speaking, an IGV mechanism 10 is provided with a plurality of airfoil blades 11 that can rotate about their own axis and have an aperture 12 in the center thereof, as shown in FIG. 1. When the operating load is reduced, the inlet guide vanes of the centrifugal compressor are gradually closed, and the air inflow is reduced accordingly. However, under lower load conditions, such an IGV mechanism will cause large flow losses when the airfoil blades rotate, thereby bringing adverse effects to the compressor performance. In addition, the jet flow flowing through the aperture easily creates aerodynamic noise, which results in poor user experience.

Figure 2:
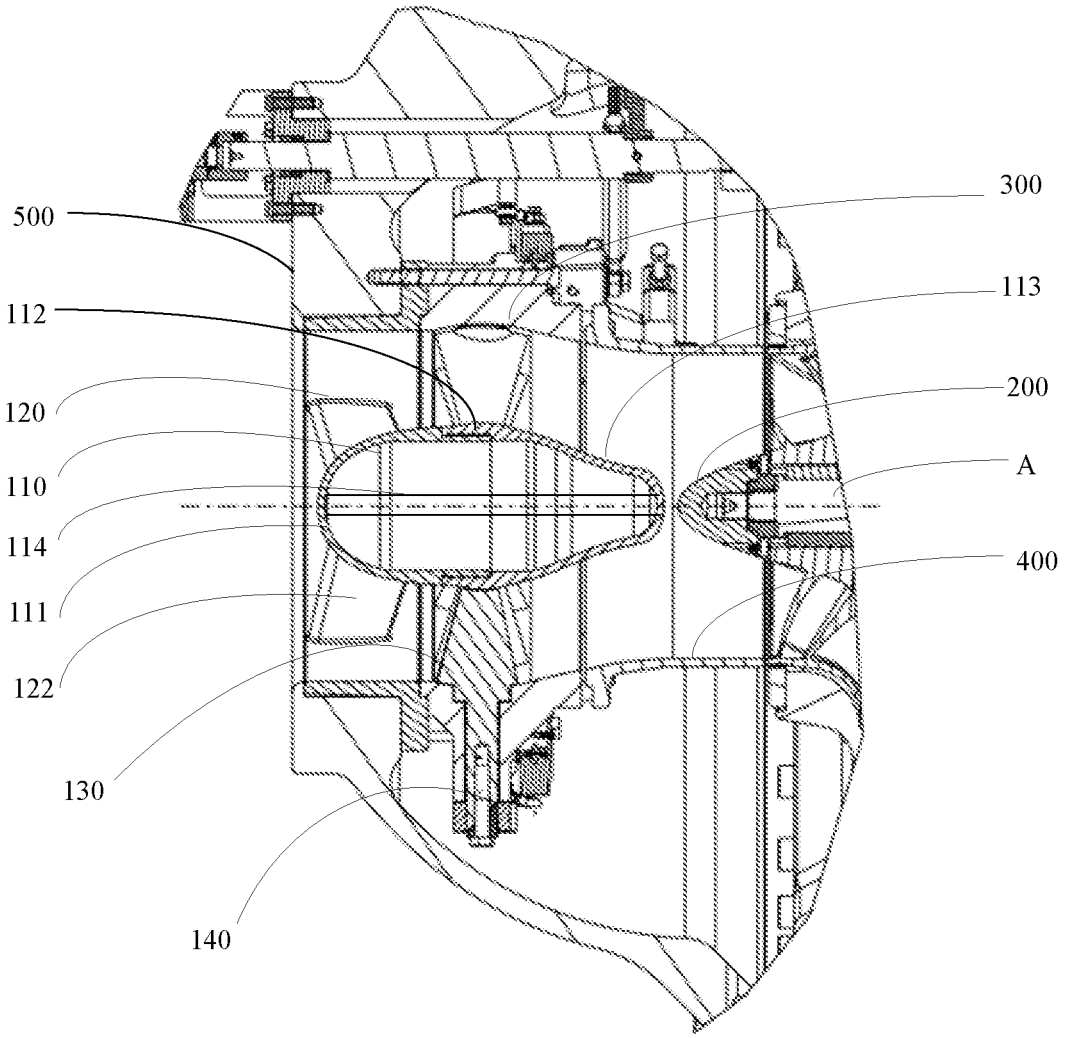
FIG. 2 shows a partial cross-sectional view of the air inlet end of a centrifugal compressor provided with an IGV mechanism for a centrifugal compressor according to the present invention.

As shown in FIG. 2, it schematically illustrates the structure of an embodiment of an IGV mechanism for a centrifugal compressor according to the present invention in general. As can be clearly seen from FIGS. 2-4, the IGV mechanism 100 is composed of a flow guide body 110, a support structure 120, and a plurality of inlet guide vanes 130, etc. The flow guide body 110 is fixed at the air inlet end of the centrifugal compressor through the support structure 120, and has a front end section 111, a middle section 112 and a rear end section 113. Here, "front" and "rear" are defined relative to the flow direction of the fluid. According to the flow of the refrigerant gas, the airflow flows in sequence through the front end section 111, the middle section 112 and the rear end section 113 of the flow guide body 110, and then enters an inlet passage 400 where an impeller hub 200 is located. Therefore, the front end section 111 is close to the frontmost side of the air inlet end of the centrifugal compressor, and the rear end section 113 is close to the front end of the impeller hub 200, such as the nose of the impeller hub 200. Generally speaking, the impeller hub 200 is sleeved on the end of the rotating shaft of the impeller, and it is the only component inside the centrifugal compressor that is in contact with the airflow to work. Since the flow guide body 110 itself does not rotate with the impeller hub 200, the nose of the impeller hub 200 does not need to be in contact with the rear end section 113. That is, there is a certain clearance between the nose of the impeller hub 200 and the rear end section 113. In addition, as shown in the figure, the front end section 111, the middle section 112 and the rear end section 113 respectively have streamlined contours in rotational symmetry about the impeller axis A and are transitionally connected by smooth curved surfaces, which is conducive to decreasing aerodynamic drag and reducing airflow losses. Furthermore, the surface profile of the rear end section 113 of the flow guide body 110 is discontinuous with the front end of the impeller hub, such as the surface profile of the nose of the impeller hub 200. It is designed in such a way that the shape and size of the front end of the impeller hub downstream of the flow guide body is not subject to any restrictions. Therefore, the front end of the impeller hub can retain the self-locking function of the nose to the impeller, so when the ordinary guide vane structure is being replaced, it can be directly replaced, which simplifies the process and does not affect other components. Of course, a nose may not be arranged according to specific needs.

Figure 3:
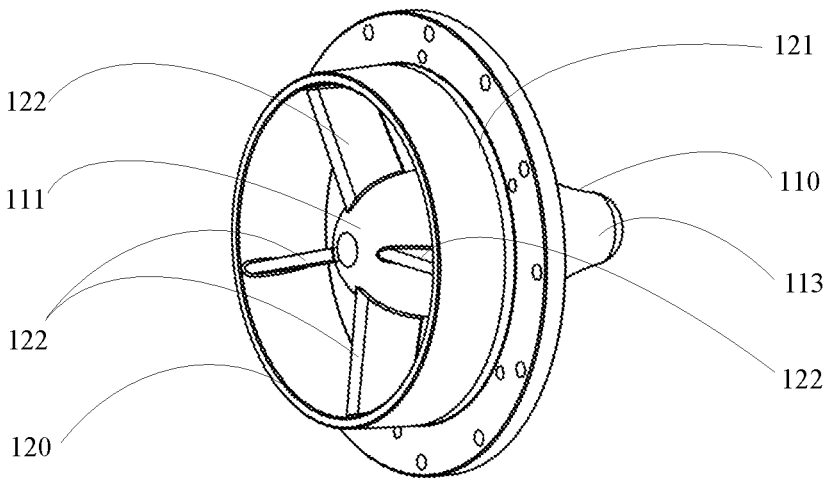
FIG. 3 shows a perspective view of a flow guide body and a support structure of an IGV mechanism for a centrifugal compressor according to the present invention.
Figure 4:
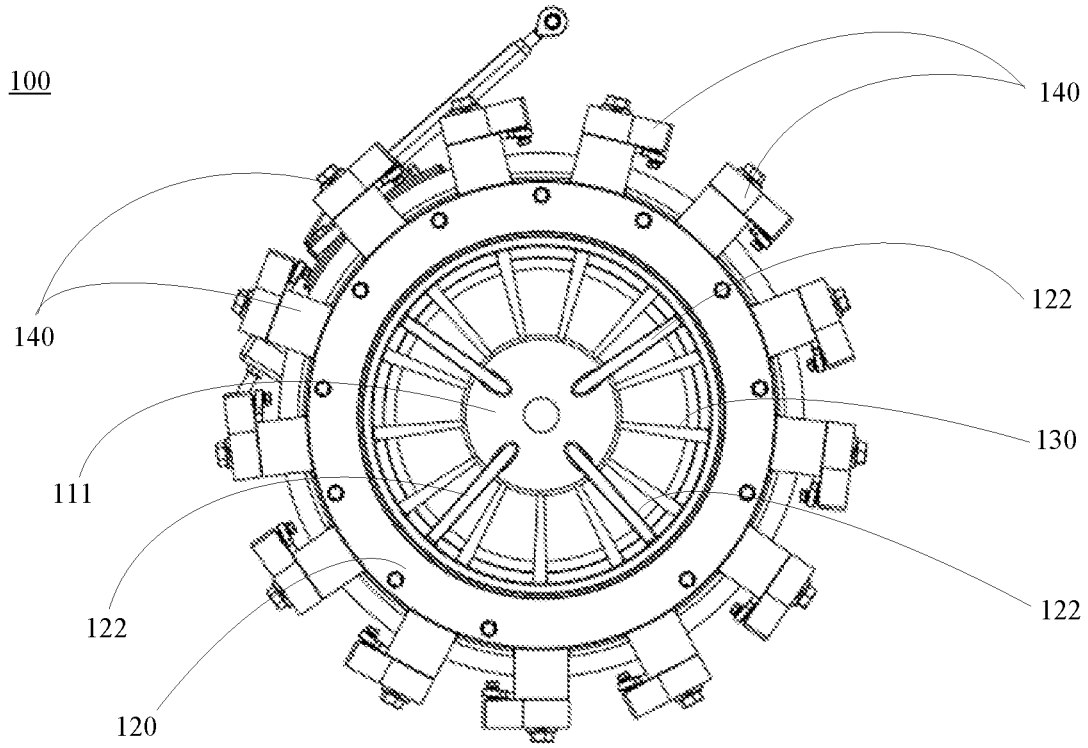
FIG. 4 shows a front view of an IGV mechanism for a centrifugal compressor according to the present invention.

In the aforementioned embodiment shown in FIGS. 2-4, the plurality of inlet guide vanes 130 are arranged in the circumferential direction of the middle section 112 of the flow guide body 110, and can rotate about their own rotation axis, so as to control the quantity of flow of the gas entering into the compressor. Each inlet guide vane 130 can take the form of an airfoil blade, and is provided with a corresponding actuator 140 fixedly mounted on a cylinder shell 300 at the air inlet end of the centrifugal compressor through a fixing seat. One end of the cylindrical shell 300 is kept in communication with the inlet passage 400 where the impeller hub 200 is located, and the other end of the cylindrical shell 300 is fixedly connected to an end cover 500 at the air inlet end of the centrifugal compressor. It should be noted that, the actuator 140 may be of a pneumatic or electric type, so as to meet the requirements for adjustment accuracy in the industry. The special configuration of the flow guide body is not only conducive to reducing the flow losses of the airflow, but also enables the length of the inlet guide vane to be greatly shortened. Under low load conditions, compared with the traditional inlet guide vane as shown in FIG. 1, the opening of the inlet guide vane in the IGV mechanism of the present invention can be relatively large, that is, the opening thereof does not need to be particularly small. At the same time, since there is no aperture in the center of the inlet guide vanes, it can greatly improve the noise problem and enhance user experience.

With continued reference to FIG. 2, the flow guide body 110 comprises an air inlet pipe 114, which is arranged along the impeller axis A and may be in the form of a smooth straight pipe. One end of the air inlet pipe 114 is fixed at the front end section 111 of the flow guide body 110, and the other end thereof is fixed at the rear end section 113 of the flow guide body 110. The inside of the air inlet pipe 114 of the flow guide body 110 is an airflow passage with uniform airflow. Under partial load of extremely small refrigerating capacity, the opening of the inlet guide vane 130 is usually very small. At this time, the airflow at the inlet guide vane 130 is relatively turbulent. However, by virtue of the air inlet pipe 114, the air inlet end of the centrifugal compressor can be supplemented with a stable and uniform airflow, so as to avoid turbulent air inflow of the impeller and increase of vibration losses caused by the small opening of the guide vane at the minimum quantity of flow.

Figure 5:
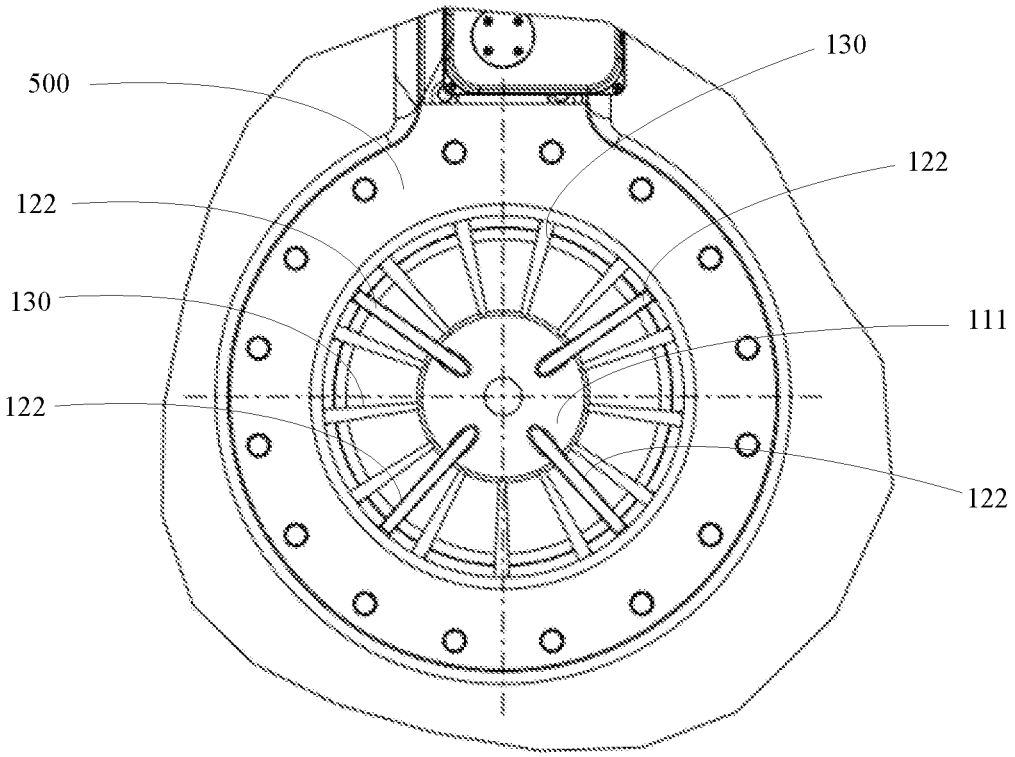
FIG. 5 shows a partial front view of the air inlet end of a centrifugal compressor provided with an IGV mechanism for a centrifugal compressor according to the present invention.

In conjunction with the above embodiment, in other preferred embodiments, the support structure 120 comprises: an annular support body 121 and a plurality of support rods 122. The support body 121 is fixed at the air inlet end of the centrifugal compressor, for example, fixed at the end cover 500 of the centrifugal compressor through bolts. The plurality of support rods 122 extend in the radial direction of the front end section 111 of the flow guide body 110, wherein one end of the plurality of support rods 122 are fixedly connected to the front end section 111, and the other end thereof are fixedly connected to the support body 121. As shown in FIGS. 3-5, the number of the plurality of support rods 122 is four, and the four support rods 122 are arranged in the radial direction of the front end section 111 of the flow guide body 110. It should be noted that the number of the support rods can be expanded, which is not limited to the above four, and can be two, three, five, six or more, and the shape of the support rods can be cylindrical, conical or other special-shaped shapes. As another alternative solution, the plurality of support rods are in the form of a plurality of airfoil blades, wherein the number of the plurality of airfoil blades is the same as the number of the plurality of inlet guide vanes 130, and the plurality of airfoil blades and the plurality of inlet guide vanes 130 coincide in the radial direction of the flow guide body as viewed from the direction of the impeller axis A. In this case, the rotating shaft of the inlet guide vanes is provided on the front side of the corresponding inlet guide vanes, and the rotatable inlet guide vanes and the airfoil blades upstream of the rotatable inlet guide vanes form two sets of "continuous vanes" to some extent. When the opening of the guide vanes is relatively small, the upstream airfoil blades can play a certain role in guiding the flow, so that the airflow separation phenomena on the surfaces of the guide vanes is relieved and the wake effect of the airfoil blades is also reduced, so as to better guide the airflow into the air inlet end of the centrifugal compressor and further reduce the flow losses of the fluid, thereby improving the efficiency of the centrifugal compressor.

As can be seen from FIG. 2, the flow guide body 110 comprises a first housing half and a second housing half, wherein the first housing half defines the space of the front end section 111, and the second housing half defines the space of the middle section 112 and the rear end section 113. And, the first housing half and the second housing half are fixed by threaded connection, welding, riveting or interference fit and so on. In addition to the aforementioned two-stage structure, the flow guide body can also be designed as a three-stage structure. That is, the flow guide body comprises a first housing portion, a second housing portion and a third housing portion, which respectively define the space of the front end section, the space of the middle section and the space of the rear end section. In addition, those skilled in the art can readily conceive of designing the flow guide body as an integrated structure, which is not limited herein.

In addition, as shown in FIG. 2, in the IGV mechanism according to the present invention, the inner wall of the cylinder shell 300 where the plurality of inlet guide vanes 130 are located has a partially spherical surface, and the vane roots of the plurality of inlet guide vanes 130 have a shape adapted to the partially spherical surface of the inner wall of the cylinder shell 300, so that when the airflow passes through the vane roots of the inlet guide vanes, airflow losses can be reduced to the greatest extent. At the same time, the middle section 112 comprises a partially spherical surface, and the vane tips of the plurality of inlet guide vanes 130 are provided with a shape adapted to the partially spherical surface of the middle section 112, so that when the airflow passes through the vane tips of the inlet guide vanes 130, airflow losses can be reduced to the greatest extent. At this time, the center of the partially spherical surface of the middle section 112 and the central axis of the plurality of inlet guide vanes 130 may be located on the same radial plane of the flow guide body 110. It can be appreciated that the employment of partially spherical surfaces in the middle section of the flow guide body and the inner wall of the cylinder shell where the inlet guide vanes are located can further reduce the flow losses when the airflow passes through the inlet guide vanes.

As an example, the flow guide body 110 can be designed as a spindle-like hollow structure. The radius of the partially spherical surface of the middle section 112 is greater than the maximum radius of the front end section 111 and the maximum radius of the rear end section 113, and the maximum radius of the front end section 111 is greater than the maximum radius of the rear end section 113, as shown in FIG. 2. In addition, the flow guide body 110 and the support structure 120 may be made of high-strength metal, so that the thickness of the hollow structure of the flow guide body 110 is designed to be as small as possible, thereby reducing the weight of the flow guide body 110. Of course, the thickness of the hollow structure may be uniform or non-uniform along the perimeter of its corresponding cross-sectional geometry. For manufacturing convenience, both the flow guide body 110 and the support structure 120 may be formed by casting or forging.

In addition, the present invention further provides a centrifugal compressor provided with an impeller hub and the IGV mechanism according to the various embodiments, so that the centrifugal compressor has high economical efficiency in the entire operating condition and stable operating conditions of the centrifugal compressor can be broadened. As mentioned above, the front end of the impeller hub 200 is provided with a nose, and the surface profile of the rear end section 113 of the flow guide body 110 is discontinuous with a surface profile of the nose. Furthermore, the present invention further provides a refrigeration system provided with the aforementioned centrifugal compressor. The refrigeration system may comprise a cooling tower, a chiller, a pumping assembly, etc. connected by pipelines, wherein the chiller is composed of a centrifugal compressor, a condenser, a throttle assembly and an evaporator, and the like. As mentioned above, the aforementioned centrifugal compressor can effectively broaden the range of stable working conditions and improve economical efficiency, so it is highly recommended to apply the aforementioned centrifugal compressor to various refrigeration systems.

The specific embodiments described above are merely intended to describe the principles of the present invention more clearly, wherein various components are clearly shown or described to facilitate the understanding of the principles of the present invention. Those skilled in the art may, without departing from the scope of the present invention, make various modifications or changes to the present invention. Therefore, it should be understood that these modifications or changes should be included within the scope of patent protection of the present invention.

What is claimed is:

1. An inlet guide vane mechanism for a centrifugal compressor, comprising:

a flow guide body having a front end section, a middle section and a rear end section, wherein the front end section, the middle section and the rear end section respectively have streamline contours in symmetry about an impeller axis and are transitionally connected by smooth curved surfaces, the flow guide body comprises an air inlet pipe arranged along the impeller axis, one end of the air inlet pipe being fixed at the front end section of the flow guide body, and the other end thereof being fixed at the rear end section of the flow guide body;

a support structure for fixing the flow guide body at an air inlet end of the centrifugal compressor; and a plurality of inlet guide vanes rotatably fixed in a circumferential direction of the middle section of the flow guide body through a rotating shaft thereof, respectively.

2. The inlet guide vane mechanism according to claim 1, wherein the support structure comprises:

an annular support body fixed at an end cover of the centrifugal compressor; and a plurality of support rods, one end of the plurality of support rods being fixedly connected with the front end section of the flow guide body, and the other end thereof being fixedly connected with the support body.

3. The inlet guide vane mechanism according to claim 2, wherein the plurality of support rods are a plurality of airfoil blades, the number of the plurality of airfoil blades is the same as the number of the plurality of inlet guide vanes, the plurality of airfoil blades and the plurality of inlet guide vanes coincide in a radial direction of the flow guide body as viewed from the direction of the impeller axis, and the rotating shaft of the inlet guide vanes is arranged on a front side of the corresponding inlet guide vanes.

4. The inlet guide vane mechanism according to claim 2, wherein the number of the plurality of support rods is at least two, and at least two of the support rods are arranged in a radial direction along the front end section of the flow guide body.

5. The inlet guide vane mechanism according to claim 3, wherein the flow guide body comprises a first housing half and a second housing half, the first housing half defining space of the front end section, and the second housing half defining space of the middle section and the rear end section.

6. The inlet guide vane mechanism according to claim 3, wherein the flow guide body is a hollow spindle-like structure, wherein radius of a partially spherical surface of the middle section is greater than the maximum radius of the front end section and the maximum radius of the rear end section, and the maximum radius of the front end section is greater than the maximum radius of the rear end section.

7. The inlet guide vane mechanism according to claim 3, wherein an inner wall of a cylinder shell where the plurality of inlet guide vanes are located is provided with a partially spherical surface, and the vane roots of the plurality of inlet guide vanes are provided with a shape adapted to the partially spherical surface of the inner wall of the cylinder shell; the middle section is provided with a partially spherical surface, and the vane tips of the plurality of inlet guide vanes are provided with a shape adapted to the partially spherical surface of the middle section.

8. The inlet guide vane mechanism according to claim 3, wherein the flow guide body and the support structure are made of metal and formed by casting or forging.

9. A centrifugal compressor, wherein the centrifugal compressor is provided with an impeller hub and the inlet guide vane mechanism according to any of claim 1.

10. The centrifugal compressor according to claim 9, wherein the front end of the impeller hub is provided with a nose, and the surface profile of the rear end section of the flow guide body is discontinuous with a surface profile of the nose.

11. A refrigeration system, wherein the refrigeration system is provided with the centrifugal compressor according to claim 9.

* * * * *